US010060699B1

(12) United States Patent
Hu

(10) Patent No.: US 10,060,699 B1
(45) Date of Patent: Aug. 28, 2018

(54) BUTT STRUCTURE FOR A TOY GUN

(71) Applicant: Shih-Che Hu, Tainan (TW)

(72) Inventor: Shih-Che Hu, Tainan (TW)

( * ) Notice: Subject to any disclaimer, the term of this patent is extended or adjusted under 35 U.S.C. 154(b) by 0 days.

(21) Appl. No.: 15/726,368

(22) Filed: Oct. 5, 2017

(30) Foreign Application Priority Data

Sep. 22, 2017 (TW) ..... 106214102 U

(51) Int. Cl.
*F41C 23/04* (2006.01)
*F41B 7/08* (2006.01)
*F41C 23/14* (2006.01)

(52) U.S. Cl.
CPC ..... *F41C 23/04* (2013.01); *F41B 7/08* (2013.01); *F41C 23/14* (2013.01)

(58) Field of Classification Search
CPC ..... F41C 23/04; F41C 23/14
See application file for complete search history.

(56) References Cited

U.S. PATENT DOCUMENTS

2016/0069636 A1* 3/2016 Gomirato ..... F41C 23/14 42/73
2017/0023328 A1* 1/2017 Irvin ..... F41C 23/04

FOREIGN PATENT DOCUMENTS

DE 2260062 * 6/1974

* cited by examiner

*Primary Examiner* — Stephen Johnson
(74) *Attorney, Agent, or Firm* — Raymond Y. Chan; David and Raymond Patent Firm

(57) ABSTRACT

A butt structure for a toy gun includes: a butt body, a rear part, two guide rods and a press locking device. The guide rods are inserted at two sides of the butt body and can move together with the rear part. The press locking device is connected to the butt body. The guide rods each include a front cavity and rear cavities. Each of the front cavities includes a hook portion on an inner front surface thereof, and each of the engaging ends includes a front protrusion. Operating the press locking device can make the engaging ends engage with the front or the rear cavities, so as to adjust the position of the rear part back and forth. When the hook portions engage with the front protrusions, the guide rods are fixed to prevent the rear part from being pulled out backwards.

3 Claims, 16 Drawing Sheets

BUTT STRUCTURE FOR A TOY GUN

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a butt structure for a toy gun, and more particularly to a butt structure capable of facilitating backward removal of the rear part of the butt.

Description of Related Arts

In addition to the exterior design simulation for real guns, the structure of the toy guns are also designed to be almost the same as real guns in order to gain consumers' fondness for toy guns. However, the power source of the toy guns is different from that of the real guns after all, therefore, some structural designs are still different from the real guns, and this is inevitable.

For example, please see FIG. 1, a conventional butt structure for a toy gun is shown and comprises: a butt body 10, a rear part 20, two guide rods 30 and a press locking device 40. The butt body 10 is axially connected to the rear end of a gun body 50, as shown in FIG. 2. As shown in FIGS. 3 and 4, the guide rods 30 have their rear ends connected (by screw means for example) to the rear part 20, so that the guide rods 30 and the rear part 20 can move back and forth in a synchronous manner. Meanwhile, the guide rods 30 are inserted forward at two sides of the butt body 10, and the rear part 20 is sleeved onto the rear end of the butt body 10 (as shown in FIG. 1). Besides, each of the guide rods 30 is provided with a plurality of cavities 301, and each of the cavities 301 has two opposite straight lateral surfaces 302. The press locking device 40 is pivotally connected to the butt body 10 and includes a press portion 401 and an engaging portion 402. When the press portion 401 is not pressed, the engaging portion 402 of the press locking device 40 can be engaged with any of the cavities 301 (as shown in FIGS. 5 and 6) and stopped against the two opposite straight lateral surfaces 302, so that the rear part 20 is stopped from moving back and forth along with the guide rods 30. When the press portion 401 is pressed (as shown in FIGS. 7 and 8), the engaging portion 402 will be disengaged from the cavities 301, so that the rear part 20 can be moved back and forth along with the guide rods 30, and this is the method and structure for adjusting the rear part 20. A pin 303 (as shown in FIG. 4) is inserted in the front end of one of the two guide rods 30, the butt body 10 is provided with a guide groove 101 which is located along the movement path of the pin 303. When pressing the press portion 401 to adjust the position of the rear part 20, the pin 303 will slide within the guide groove 101 (as shown in FIG. 8), and the pin 303 is stopped against the end of the guide groove 101 to prevent the disengagement of the guide rods 30 and the rear part 20, and this is the design for preventing disengagement of the rear part 20. However, the interior of the butt body 10 is provided for storage of wire and battery, and every time when the battery needs to be replaced, it has to remove the pin 303 and press the press portion 401, then the rear part 20 and the guide rods 30 can be removed to replace the battery from the rear end of the butt body 10, and the pin 303 has to be reinserted back to its original position after battery replacement.

The present invention has arisen to mitigate and/or obviate the afore-described disadvantages.

SUMMARY OF THE PRESENT INVENTION

Based on the above disadvantages, the problem to be solved by the present invention is how to provide an effective and improved structure which is not only capable of preventing the rear part of the butt from being pulled out backwards, but also allowing for easy removable of the rear part.

The technical scheme adopted by the invention to solve the above problems is to provide a butt structure for a toy gun which comprises: a butt body, a rear part, two guide rods and a press locking device, wherein the butt body is axially connected to a rear end of a gun body, the guide rods have their rear ends connected to the rear part and are inserted forward at two sides of the butt body, the rear part is sleeved onto a rear end of the butt body, each of the guide rods is provided with a plurality of cavities, the press locking device is connected to the butt body and includes a press portion, when the press portion is not pressed, the press locking device is able to engage with any of the cavities, so that the rear part is unable to move along with the guide rods, and when the press portion is pressed, the press locking device is disengaged from the cavities, so that the rear part is able to move back and forth along with the guide rods. The butt structure is characterized in that: the cavities of each of the two guide rods include one front cavity and at least two rear cavities, each of the front cavities is provided with a hook portion on an inner front surface thereof, the press locking device further includes two engaging ends, each of the engaging ends is provided with a front protrusion at a front surface thereof, when the press portion is not pressed, and the hook portions are engaged with the front protrusions, the part and the two guide rods are fixed from moving backwards. Therefore, simply operating the press locking device can both prevent the rear part and the guide rods from being pulled out backwards and allow the rear part and the guide rods to be removed to facilitate battery replacement.

Preferably, each of the front cavities and the rear cavities includes a straight inner rear surface, each of the engaging ends is provided with a right-angle portion at a rear surface thereof, when the right-angle portions are stopped against the straight inner rear surfaces, the rear part and the guide rods are fixed from moving forward.

Preferably, each of the rear cavities is provided with a front slanting surface on an inner front surface thereof, when the engaging ends are engaged in the rear cavities, the front slanting surfaces are able to slide over the front protrusions of the engaging ends, so that the rear part and the guide rods are able to move backward.

Preferably, the press locking device includes two extension arms extending from two lateral sides of one end of the press locking device opposite to the press portion, the engaging ends are located at top ends of the extension arms, the butt body is provided with a T-shaped slot, the press locking device is pivotally disposed in the T-shaped slot, and a spring is disposed between the press portion and the butt body.

The objective of the invention is to provided a butt structure for a toy gun, wherein each of the front cavities is provided with the hook portion on an inner front surface thereof, and each of the engaging ends is provided with the front protrusion at a front surface thereof, when the guide rods are moved backward to the position where the hook portions are engaged with the front protrusions by operating the press portion of the press locking device, the rear part and the guide rods can be fixed from moving backward, namely, the rear part and the guide rods can be prevented from being pulled out backwards. To remove the rear part and the guide rods by pulling them backward, the user can still operate the press portion of the press locking device to release the engaging ends from the cavities. Namely, simply operating the press locking device can both prevent the rear part and the guide rods from being pulled out backwards and allow the rear part and the guide rods to be removed to facilitate battery replacement. Therefore, the invention is capable of effectively solving the disadvantages of the existing gun butt structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION OF THE PREFERRED EMBODIMENT

The present invention will be clearer from the following description when viewed together with the accompanying drawings, which show, for purpose of illustrations only, the preferred embodiment in accordance with the present invention.

Figure 1:
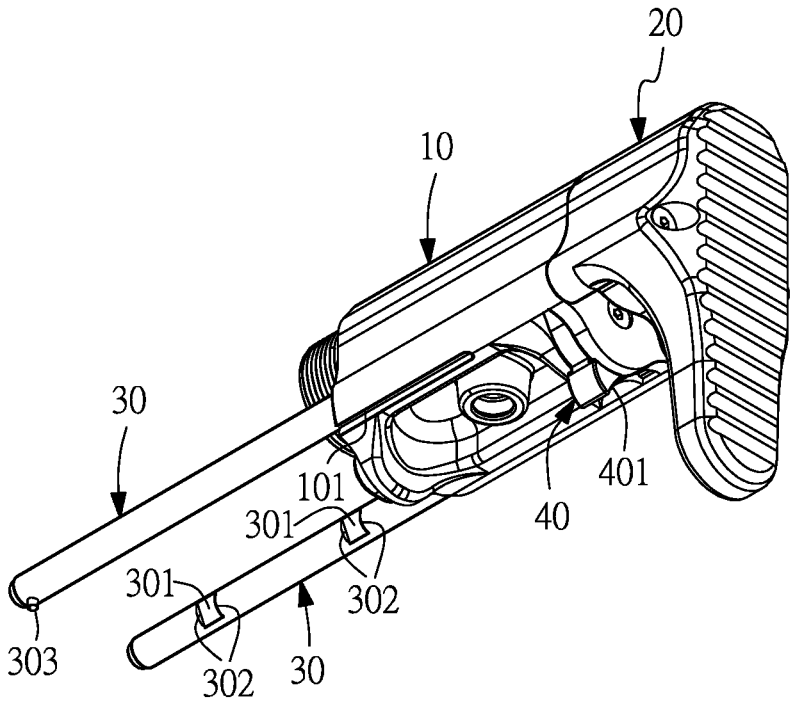
FIG. 1 (PRIOR ART)
FIG. 1 is a perspective view of a conventional butt for a toy gun.
Figure 2:
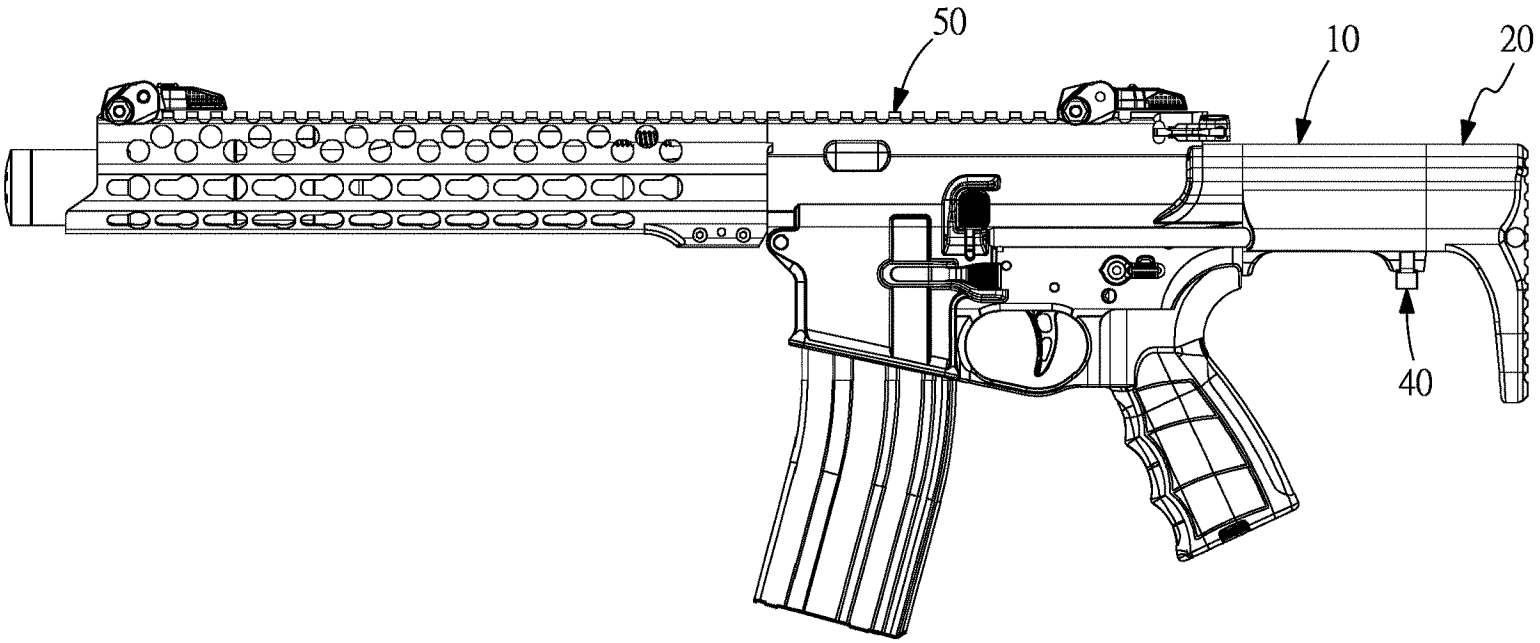
FIG. 2 (PRIOR ART)
FIG. 2 is a plan view of the conventional butt for a toy gun.
Figure 3:
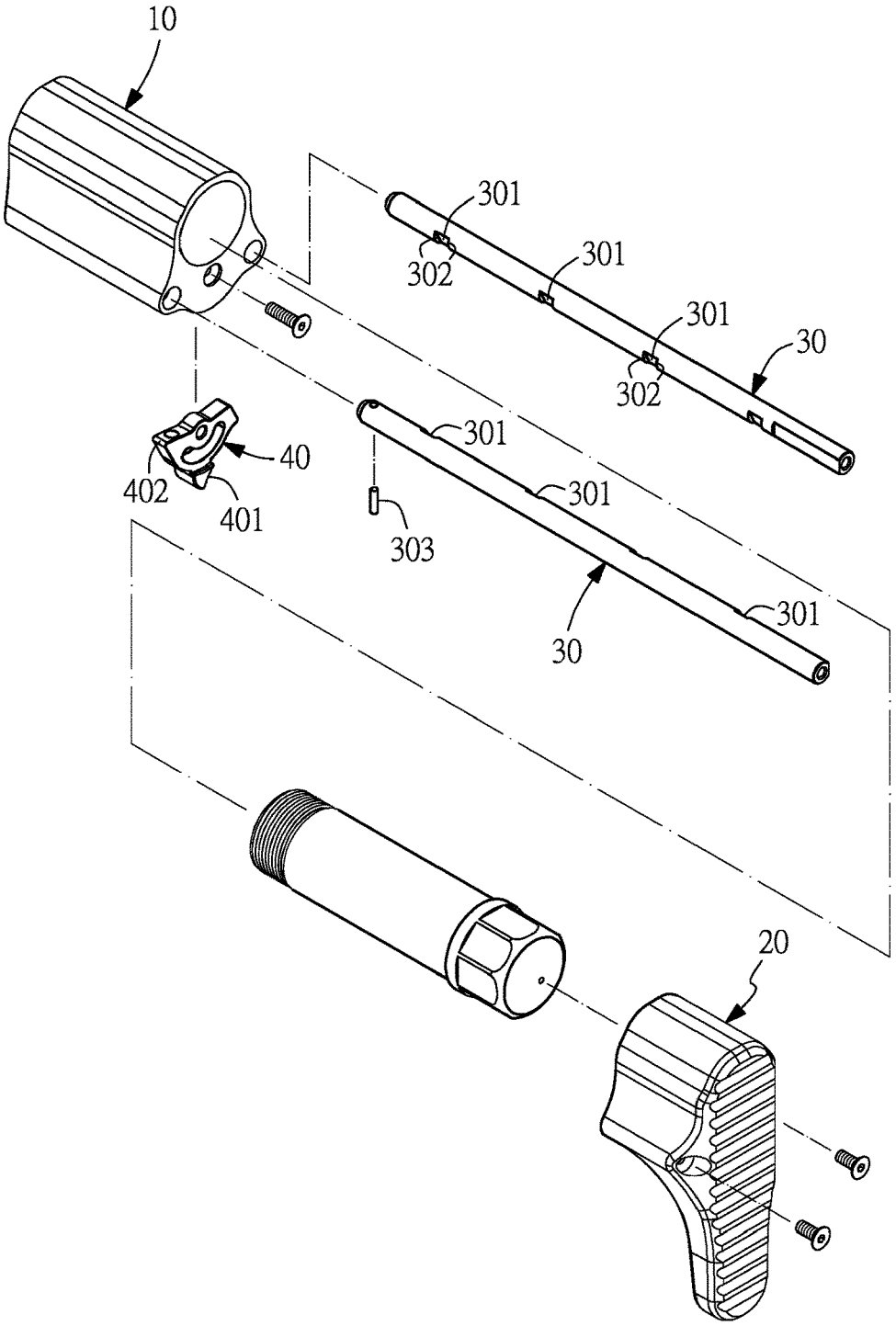
FIG. 3 (PRIOR ART)
FIG. 3 is an exploded view of the conventional butt for a toy gun.
Figure 4:
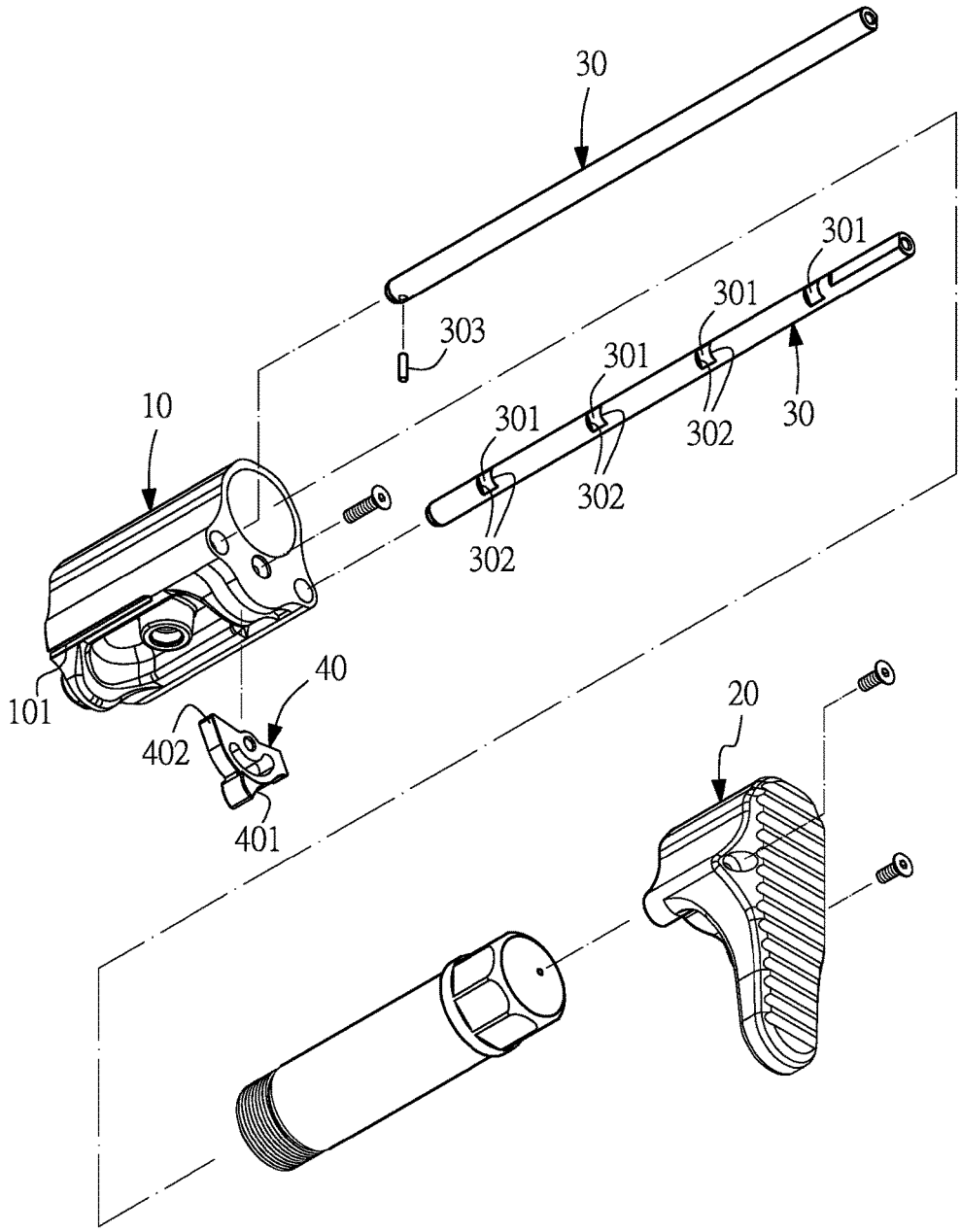
FIG. 4 (PRIOR ART)
FIG. 4 is another exploded view of the conventional butt for a toy gun.
Figure 5:
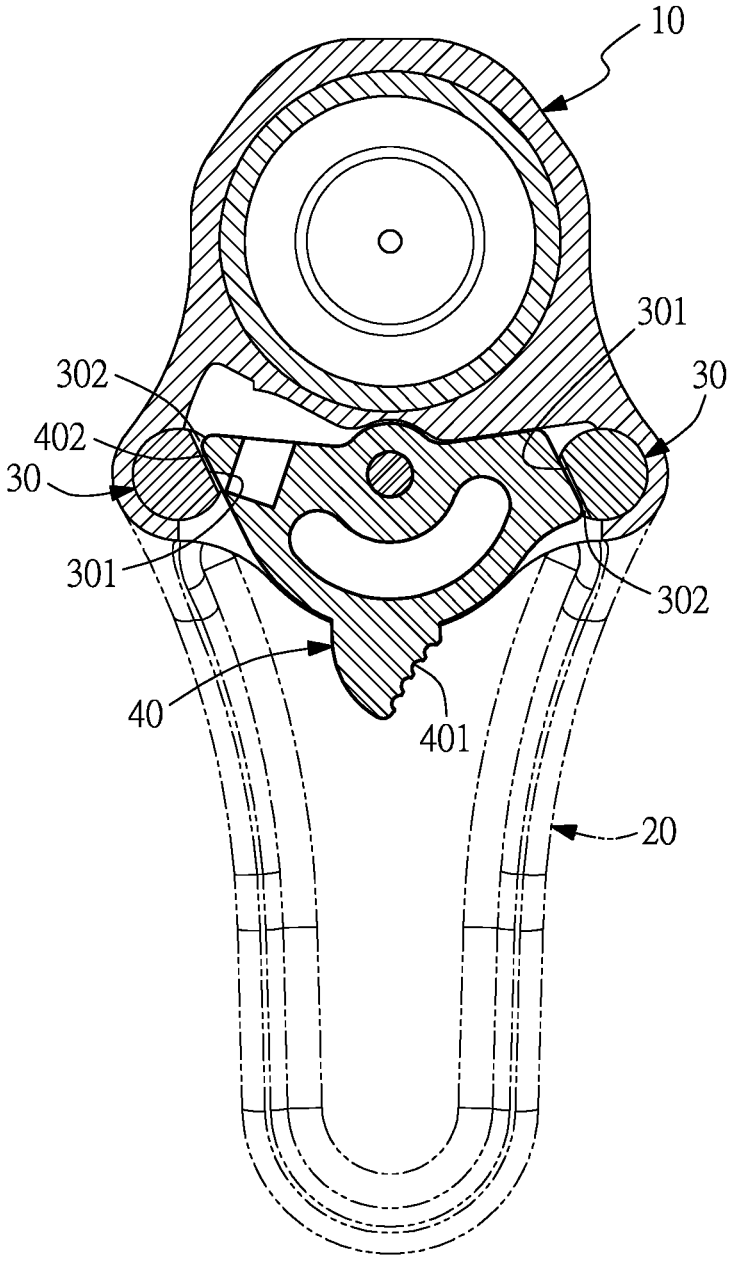
FIG. 5 (PRIOR ART)
FIG. 5 is a lateral cross sectional view of the conventional butt for a toy gun (the press portion is not pressed)
Figure 6:
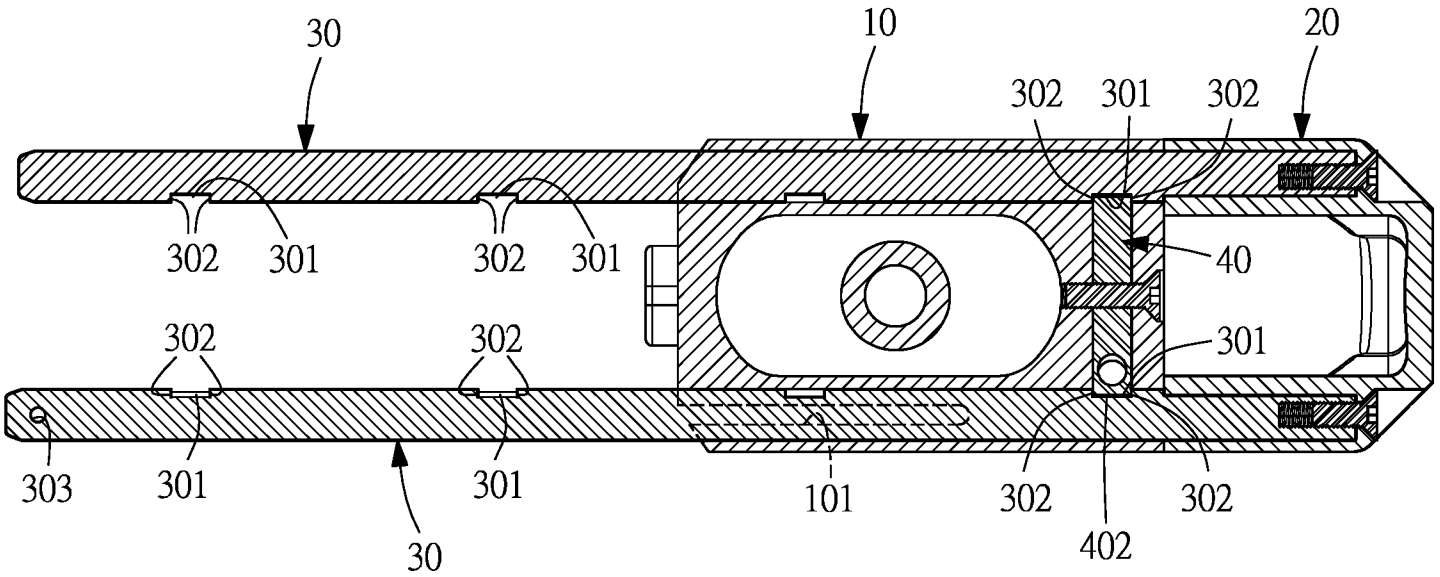
FIG. 6 (PRIOR ART)
FIG. 6 is a transverse cross sectional view of the conventional butt for a toy gun.
Figure 7:
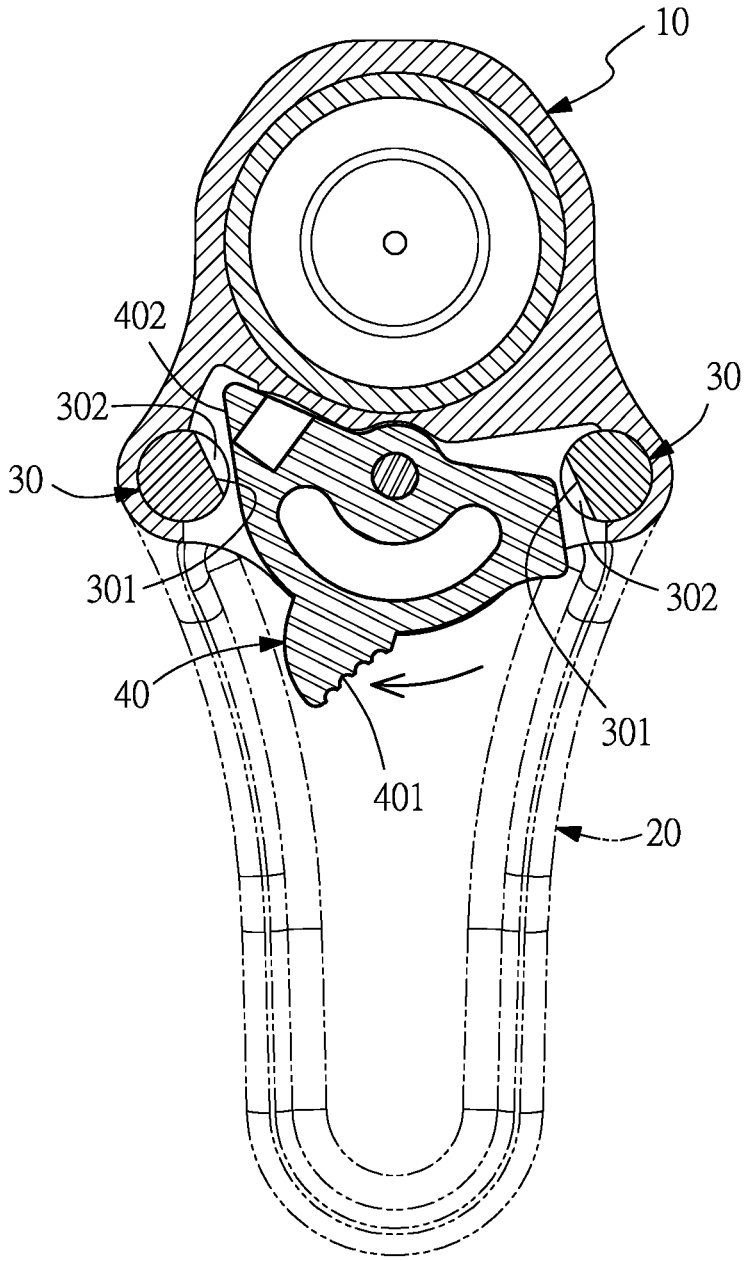
FIG. 7 (PRIOR ART)
FIG. 7 is a lateral cross sectional view of the conventional butt for a toy gun (the press portion is pressed)
Figure 8:
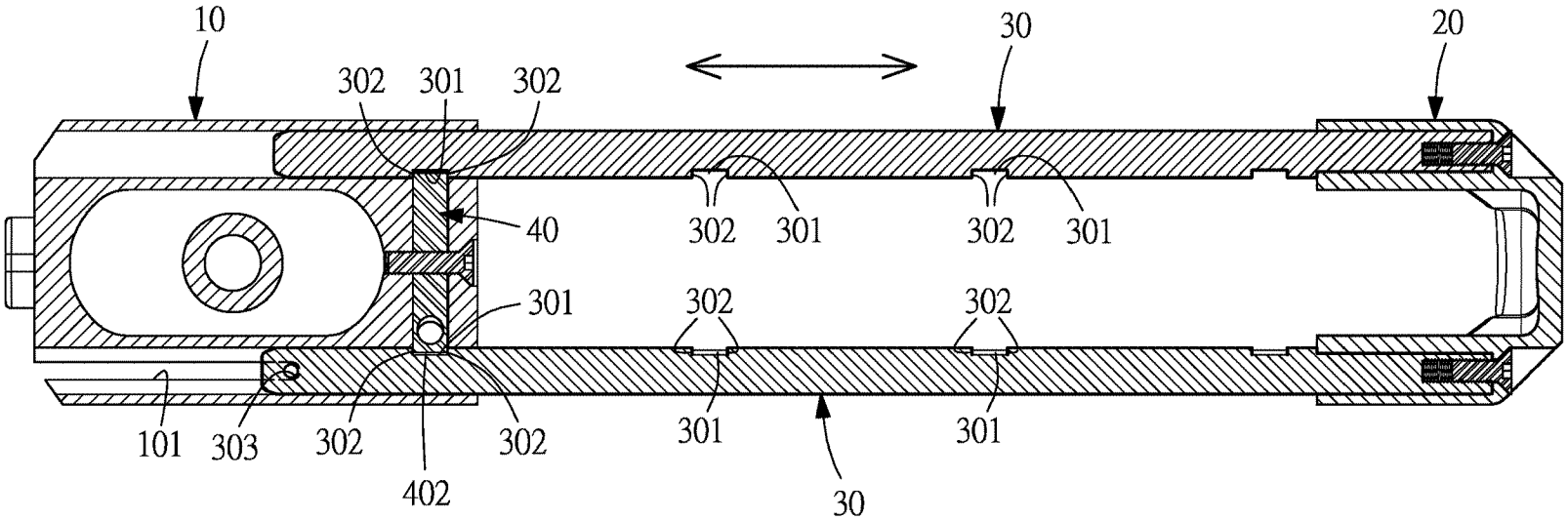
FIG. 8 (PRIOR ART)
FIG. 8 is an operational view of the conventional butt for a toy gun.
Figure 9:
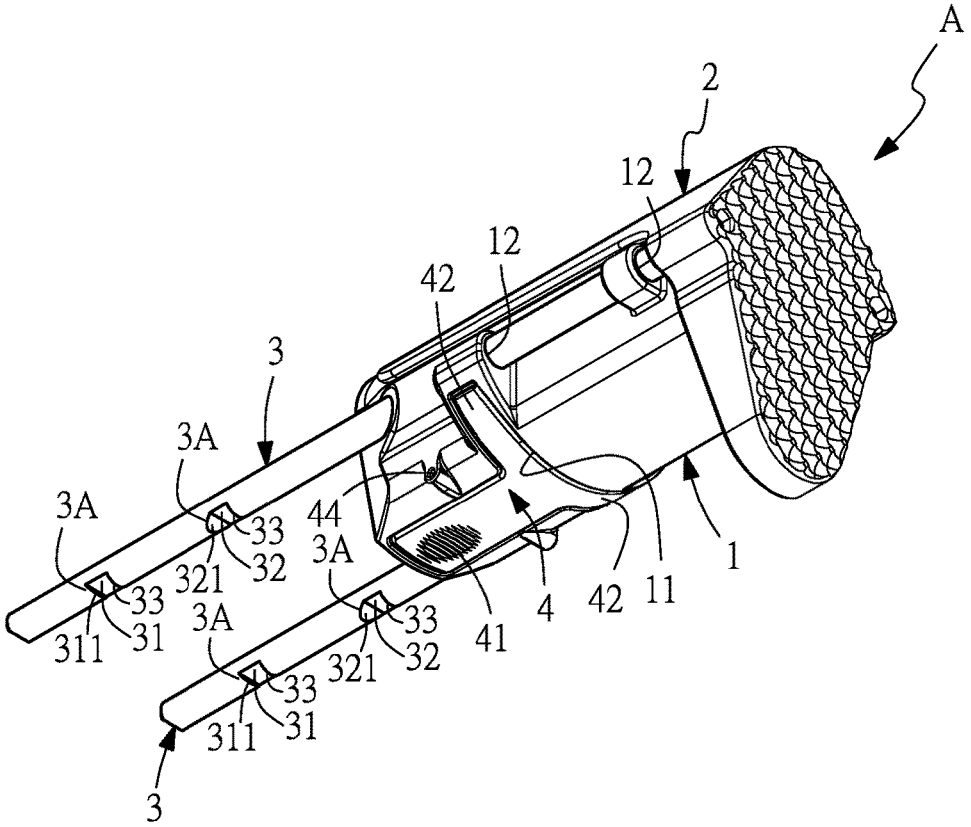
FIG. 9 is a perspective view of a butt structure for a toy gun in accordance with the present invention.

Referring to FIG. 9, a butt structure A for a toy gun in accordance with the present invention comprises: a butt body 1, a rear part 2, two guide rods 3 and a press locking device 4.

Figure 10:
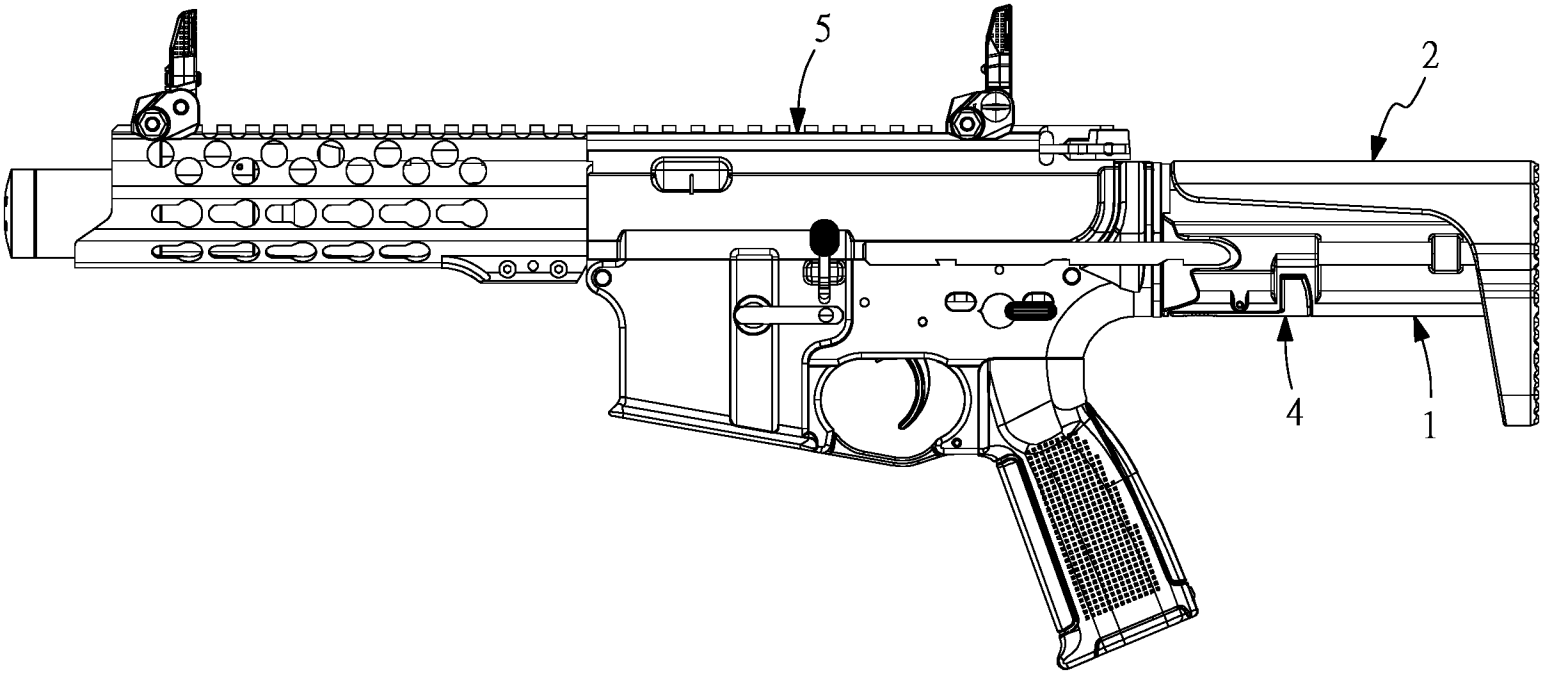
FIG. 10 is a plan view of the butt structure for a toy gun in accordance with the present invention.
Figure 12:
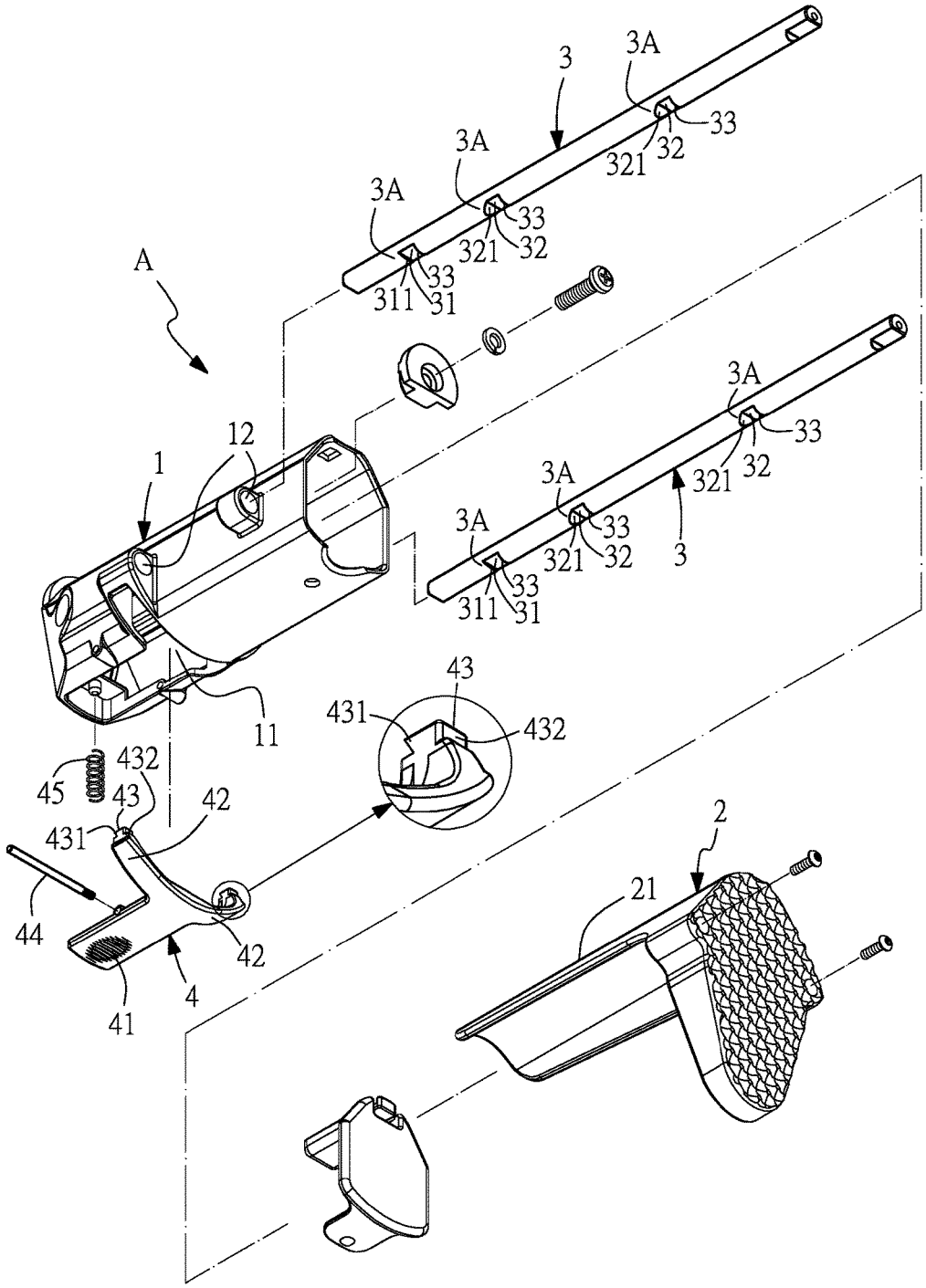
FIG. 12 is another exploded view of the butt structure for a toy gun in accordance with the present invention.

The butt body 1 is axially connected to a rear end of a gun body 5 (as shown in FIG. 10), as further shown in FIGS. 9 and 12, a T-shaped slot 11 is formed in a bottom surface of the butt body 1, at least two insertion holes 12 are formed on two lateral surfaces of the butt body 1, and one of the insertion holes 12 is located adjacent to the T-shaped slot 11.

Figure 11:
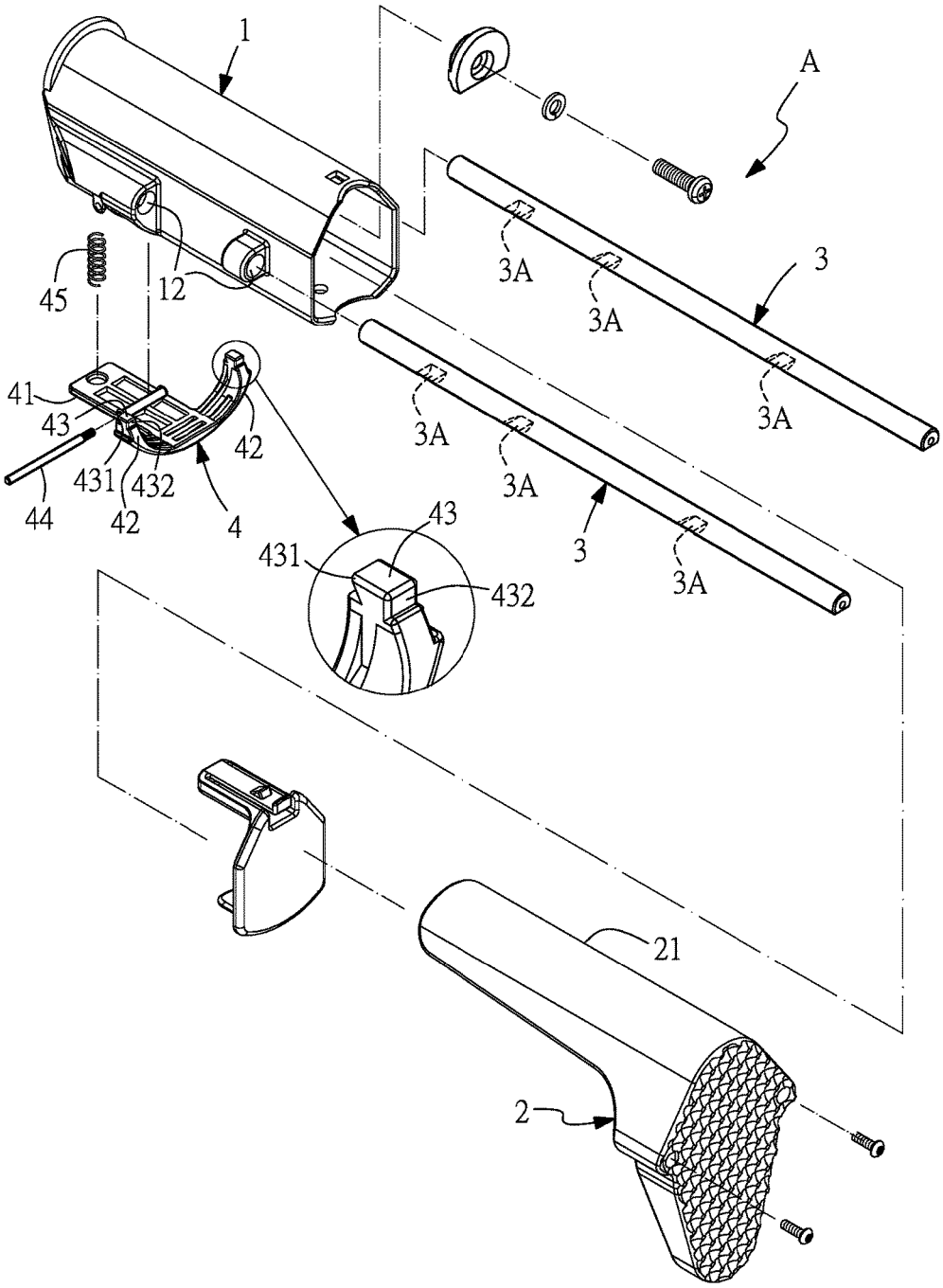
FIG. 11 is an exploded view of the butt structure for a toy gun in accordance with the present invention.

The rear part 2 is located behind the butt body 1, as shown in FIGS. 11 and 12, and a cover 21 is located above the rear part 2.

The guide rods 3 have their rear ends connected (by screw means for example) to the rear part 2, so that the rear part 2 can move together with the guide rods 3. The two guide rods 3 are inserted forward into the insertion holes 12 at two sides of the butt body 1, and the rear part 2 is sleeved onto a rear end of the butt body 1. Each of the guide rods 3 is provided with a plurality of cavities 3A (as shown in FIGS. 9 and 12), and the cavities 3A of each of the two guide rods 3 include one front cavity 31 and at least two rear cavities 32. Each of the front cavities 31 is provided with a hook portion 311 on an inner front surface thereof, each of the rear cavities 32 is provided with a front slanting surface 321 on an inner front surface thereof, and each of the front cavities 31 and the rear cavities 32 includes a straight inner rear surface 33.

The press locking device 4 includes a press portion 41 at one end thereof, and two extension arms 42 extending from two lateral sides of another end of the press locking device 4. Each of the extension arms 42 is provided with an engaging end 43 at a top end thereof (as shown in FIGS. 11 and 12). Each of the engaging ends 43 is provided with a front protrusion 431 at a front surface thereof and a right-angle portion 432 at a rear surface thereof. The press locking device 4 is pivotally disposed in the T-shaped slot 11 of the butt body 1 by a pin 44, and a spring 45 is disposed between the press portion 41 and the butt body 1. When the spring 45 is not pressed, the engaging ends 43 can be inserted into the insertion holes 12 beside the T-shaped slot 11 of the butt body 1.

Figure 13:
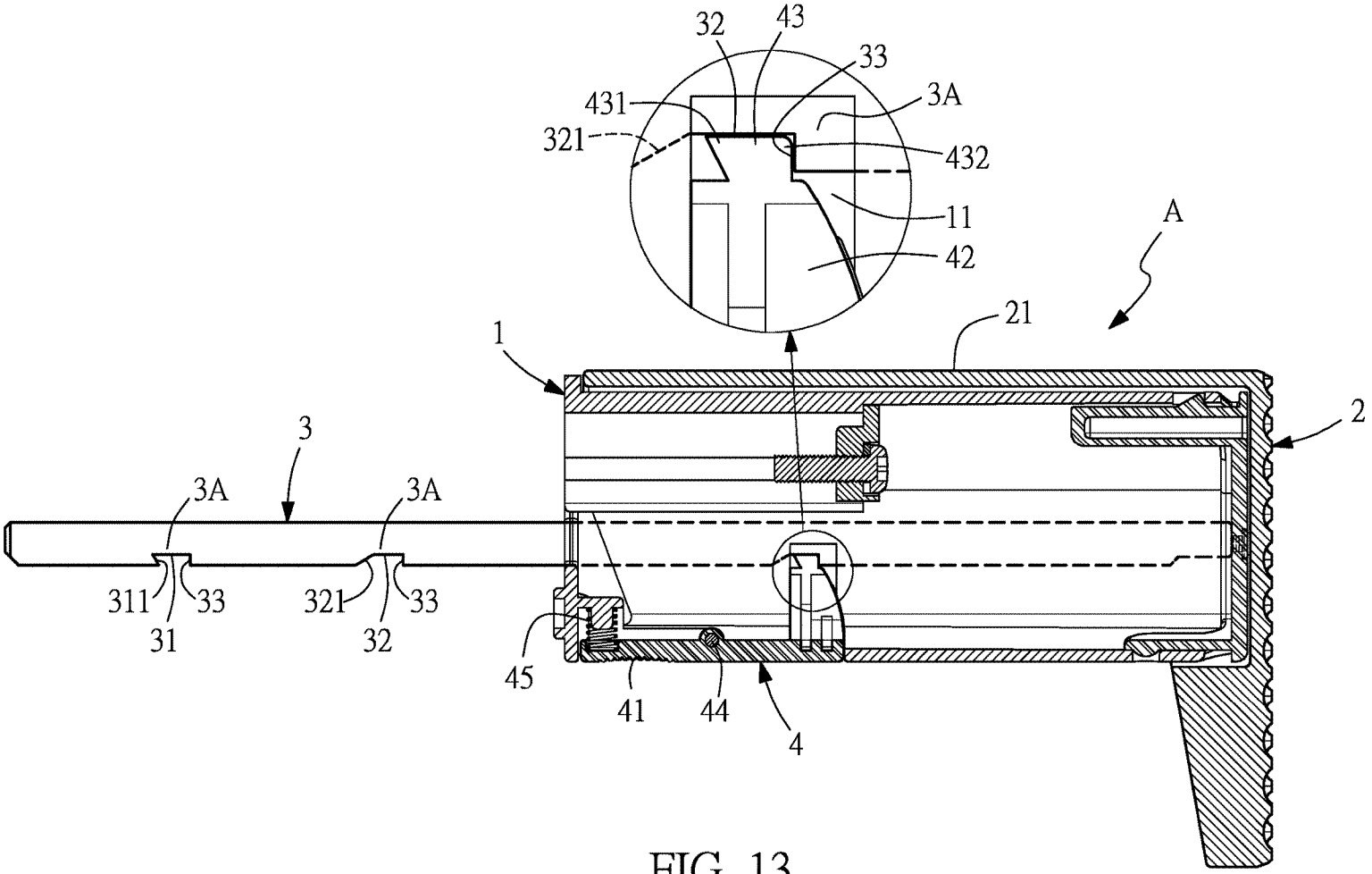
FIG. 13 is an operational view of the butt structure for a toy gun in accordance with the present invention, wherein the press portion is not pressed.
Figure 14:
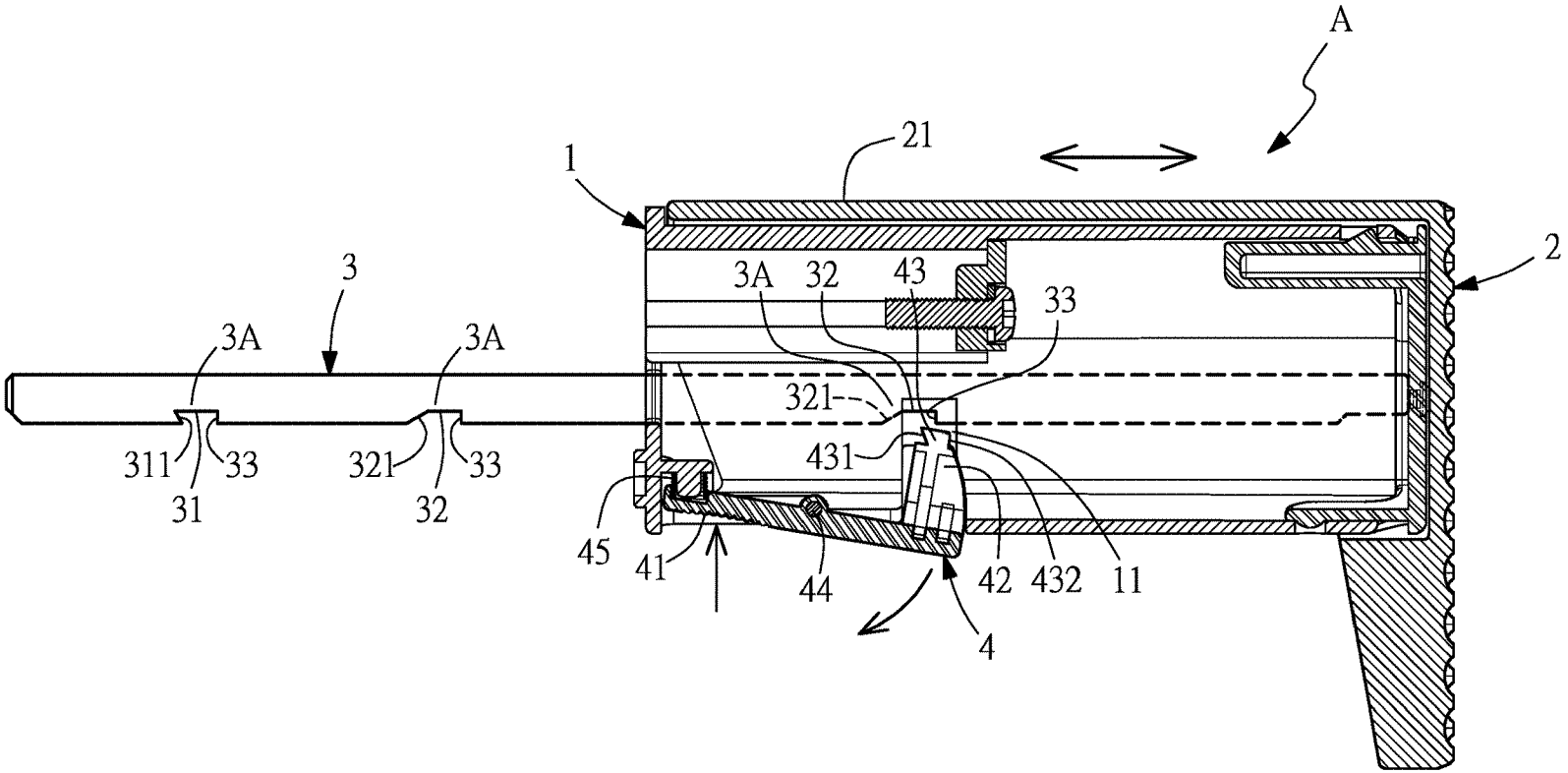
FIG. 14 is an operational view of the butt structure for a toy gun in accordance with the present invention, wherein the press portion is pressed.
Figure 15:
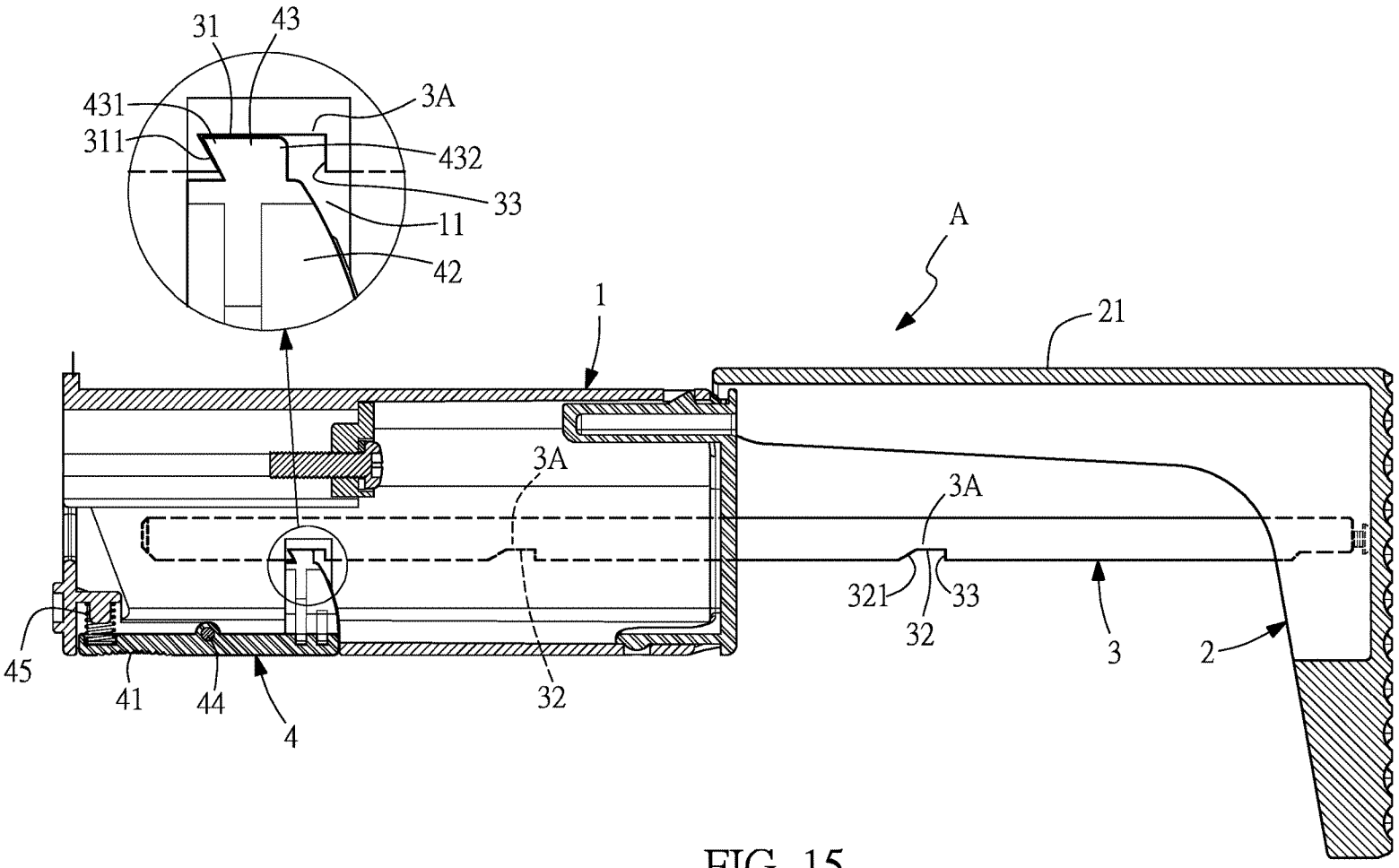
FIG. 15 is an operational view of the butt structure for a toy gun in accordance with the present invention, showing that the guide rods moved backwards to the front cavities to engage with the engaging ends.

According to the abovementioned structure, when the press portion 41 is not pressed, the engaging ends 43 can be engaged with any of the cavities 3A because of the elastic force of the spring 45, and the right-angle portion 432 is stopped against the straight inner rear surface 33 of the front cavity 31 or the rear cavities 32, so that the rear part 2 is unable to move along with the guide rods 3 (as shown in FIG. 13), and thus fixed after moving forward. When the press portion 41 is pressed, the engaging ends 43 of the press locking device 4 will be disengaged from the cavities 3A (the front cavity 31 or the rear cavities 32), so that the rear part 2 can be moved together with the two guide rods 3 (as shown in FIG. 14). When the press portion 41 is not pressed, and the guide rods 3 are moved to the hook portions 311 of the front cavities 31 and the front protrusions 431 of the engaging ends 43, at this moment, the hook portions 311 are engaged with the front protrusions 431, so that the rear part 2 and the two guide rods 3 are fixed and unable to move back and forth (as shown in FIG. 15). Hence, operating the press locking device 4 can prevent the rear part 2 and the guide rods 3 from moving backward and causing disengagement. To remove the rear part 2 and the guide rods 3, what the user only needs to do is to press the press portion 41 to release the engaging ends 43 from the cavities 3A (the front cavities 31 or the rear cavities 32), and then the rear part 2 and the guide rods 3 can be removed by being pulled backward, which can also be achieved by operating the press locking device 4.

Figure 16:
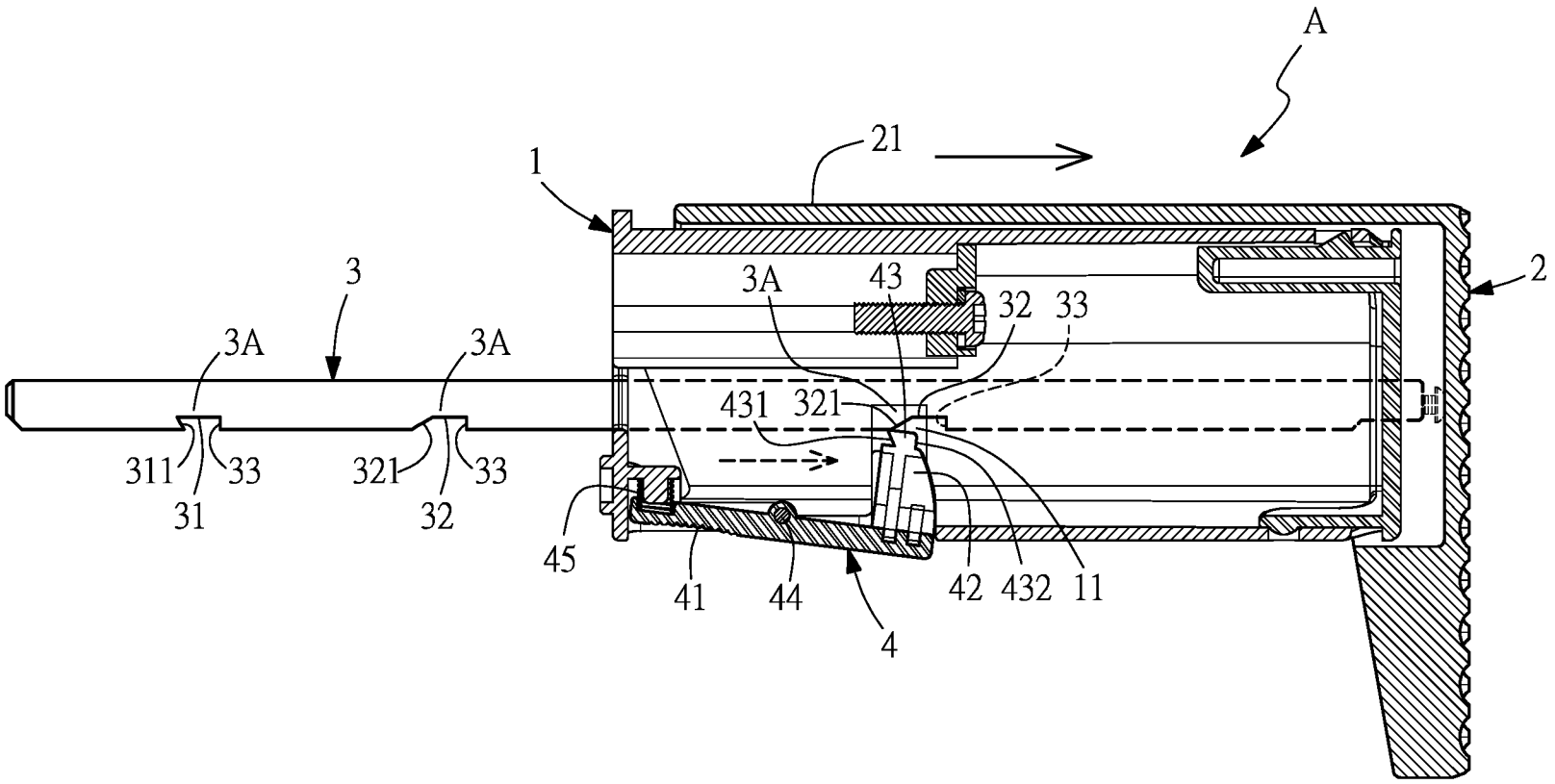
FIG. 16 is an operational view of the butt structure for a toy gun in accordance with the present invention, wherein the press portion is not pressed, and the guide rods can still be moved backwards.

Furthermore, even when the press portion 41 is not pressed, each of the rear cavities 32 is provided with the front slanting surface 321, when the engaging ends 43 are engaged in the rear cavities 32, the guide rods 3 can still be moved backward by using the front slanting surfaces 321 to slide over the front protrusions 431 of the engaging ends 43, and as a result, the rear part 2 and the guide rods 3 can still be moved backward (as shown in FIG. 16).

It can be learned from the above description that due to the fact that each of the front cavities 31 is provided with the hook portion 311 on an inner front surface thereof, and each of the engaging ends 43 is provided with the front protrusion 431 at a front surface thereof, when the guide rods 3 are moved backward to the position where the hook portions 311 are engaged with the front protrusions 431 by operating the press portion 41 of the press locking device 4, the rear part 2 and the guide rods 3 can be fixed from moving backward (as shown in FIG. 15), namely, the rear part 2 and the guide rods 3 can be prevented from being pulled out backwards. To remove the rear part 2 and the guide rods 3 by pulling them backward, the user can still operate the press portion 41 of the press locking device 4 to release the engaging ends 43 from the cavities 3A (as shown in FIG. 14). Namely, simply operating the press locking device 4 can both prevent the rear part 2 and the guide rods 3 from being pulled out backwards and allow the rear part 2 and the guide rods 3 to be removed to facilitate battery replacement. Therefore, the invention is capable of effectively solving the disadvantages of the existing gun butt structure.

While we have shown and described various embodiments in accordance with the present invention, it is clear to those skilled in the art that further embodiments may be made without departing from the scope of the present invention.

What is claimed is:

1. A butt structure for a toy gun comprising, a butt body, a rear part, two guide rods and a press locking device, wherein the butt body is axially connected to a rear end of a gun body, the guide rods have their rear ends connected to the rear part and are inserted forward at two sides of the butt body, the rear part is sleeved onto a rear end of the butt body, each of the guide rods is provided with a plurality of cavities, the press locking device is connected to the butt body and includes a press portion, when the press portion is not pressed, the press locking device is able to engage with any of the cavities, so that the rear part is unable to move along with the guide rods, and when the press portion is pressed, the press locking device is disengaged from the cavities, so that the rear part is able to move back and forth along with the guide rods;

wherein the cavities of each of the two guide rods include one front cavity and at least two rear cavities, each of the front cavities is provided with a hook portion on an inner front surface thereof, the press locking device further includes two engaging ends, each of the engaging ends is provided with a front protrusion at a front surface thereof, when the press portion is not pressed, and the hook portions are engaged with the front protrusions, the rear part and the two guide rods are fixed from moving backwards, wherein each of the rear cavities is provided with a front slanting surface on an inner front surface thereof, when the engaging ends are engaged in the rear cavities, the front slanting surfaces are able to slide over the front protrusions of the engaging ends, so that the rear part and the guide rods are able to move backward.

2. The butt structure as claimed in claim 1, wherein each of the front cavities and the rear cavities includes a straight inner rear surface, each of the engaging ends is provided with a right-angle portion at a rear surface thereof, when the right-angle portions are stopped against the straight inner rear surfaces, the rear part and the guide rods are fixed from moving forward.

3. The butt structure as claimed in claim 2, wherein the press locking device includes two extension arms extending from two lateral sides of one end of the press locking device opposite to the press portion, the engaging ends are located at top ends of the extension arms, the butt body is provided with a T-shaped slot, the press locking device is pivotally disposed in the T-shaped slot, and a spring is disposed between the press portion and the butt body.

* * * * *